United States Patent [19]

Taylor

[11] 4,103,433

[45] Aug. 1, 1978

[54] HOME LAUNDRY DRYER

[75] Inventor: James R. Taylor, Dallas, Tex.

[73] Assignee: Q-dot Corporation, Dallas, Tex.

[21] Appl. No.: 739,815

[22] Filed: Nov. 8, 1976

[51] Int. Cl.[2] ..... F26B 19/00

[52] U.S. Cl. ..... 34/86; 34/133; 165/105; 165/DIG. 12

[58] Field of Search ..... 34/86, 131, 133, 235; 165/105, DIG. 12; 432/223; 138/38

[56] References Cited

U.S. PATENT DOCUMENTS

| | | | |
|---|---|---|---|
| 2,314,748 | 3/1943 | White | 34/133 |
| 3,865,184 | 2/1975 | Grover | 165/105 |

*Primary Examiner*—Kenneth W. Sprague
*Assistant Examiner*—James C. Yeung
*Attorney, Agent, or Firm*—Hubbard, Thurman, Turner, Tucker & Glaser

[57] ABSTRACT

A home laundry dryer in which both the fresh air entering a laundry drum and the air exhausted from the drum pass through a thermal recovery unit in the dryer. The unit has a high temperature passage through which the exhaust air flows and a low temperature passage through which the entering air flows. Heat from the exhausted air is transferred by means of heat pipes from the high temperature passage to the entering air in the low temperature passage. This heat transfer lowers the energy required to raise the entering air to a selected drying temperature. The dryer, including the thermal recovery unit, fits in a housing of substantially standard size for home dryers.

20 Claims, 6 Drawing Figures

HOME LAUNDRY DRYER

BACKGROUND OF THE INVENTION

This invention relates to home laundry dryers and more particularly to dryers having a thermal recovery unit to decrease fuel consumption.

In a home laundry drying system, laundry in a drum is subjected to a flow of heated, dry air. When the air leaves the drum, it is still relatively hot compared to fresh air, and contains moisture absorbed from the laundry. The energy required for heating the fresh air entering the drum could be reduced, if heat from the drum exhaust could be used in the drying process, rather than simply discarded in the exhaust of the dryer.

One approach to utilizing exhaust air heat in laundry dryers has been to recirculate a portion of the exhaust into the drum, mixed with fresh, heated makeup air. A shortcoming of this approach is that it also carries the moisture from the exhaust back into the drum.

Another approach is to employ a heat exchanger to transfer heat from the exhaust air stream of the dryer to its fresh air stream. This approach has been suggested for a commercial type dryer in U.S. Pat. No. 3,859,735 to Katterjohn, Jr. The Katterjohn patent discloses an indirect heat exchanger, which is excessively large relative to a home dryer, and is mounted external to a dryer housing. Such a combination does not meet the space requirement of a home laundry dryer; therefore, nothing of this sort is marketed for home use. The enclosures of home dryers are designed to meet certain standards as to size and shape. With reliance on this standardization of size and shape, many homes are built with areas specifically sized to receive the dryer. Often these areas are constrained on the sides and backs by walls, and above by cabinetry. Thus a dryer which is to be mass produced must be in a substantially standard enclosure in order to fit the spaces provided for it in homes.

There is very little room for the addition of a heat exchanger in and around an installed home dryer; therefore, the exchanger must be small. Indirect heat exchangers, as used by Katterjohn, require a large amount of heat transfer surface area. One small enough to somehow fit in a home dryer would not have the heat transfer capacity to provide useful energy recovery.

The present invention uses heat pipes to achieve a compact, as well as highly effective, heat exchanger. This heat exchanger is used to transfer heat between the exhaust air and fresh air stream of a dryer. Importantly, ways have been found to integrate the heat exchanger into a home dryer of standard size and shape. The resulting machine has features which permit it to be operated and maintained in the confined installation conditions frequently encountered in the home. The result is a practical dryer that saves energy and can actually be used in the home.

SUMMARY OF THE INVENTION

In accordance with the present invention, there is provided a home laundry dryer in a housing of substantially standard size. The dryer has a drum to contain the laundry and means for generating a flow of air entering the drum and an exhaust flow from the drum. The dryer also has a thermal recovery unit, which includes a low temperature passage and a high temperature passage. There is a plurality of heat pipes, each extending across each of the passages and each having a plurality of fins in contact with it. The air entering the drum flows through the low temperature passage and is carried by a first intake duct to the drum. The intake duct has a heater to heat the air entering the drum. An exhaust duct directs the air exhausted from the drum to flow through the high temperature passage in a direction opposite to the flow of the entering air in the low temperature passage. In the thermal recovery unit, heat is transferred from the exhausted air in the high temperature passage to the entering air in the low temperature passage.

The nature of the invention, its features and advantages, as set forth above, can be understood more fully upon the consideration of particular embodiments. The following is a description of some preferred embodiments and how to make and use them. It is to be read in conjunction with the accompanying drawings.

DESCRIPTIONS OF THE PREFERRED EMBODIMENTS

Figure 1:
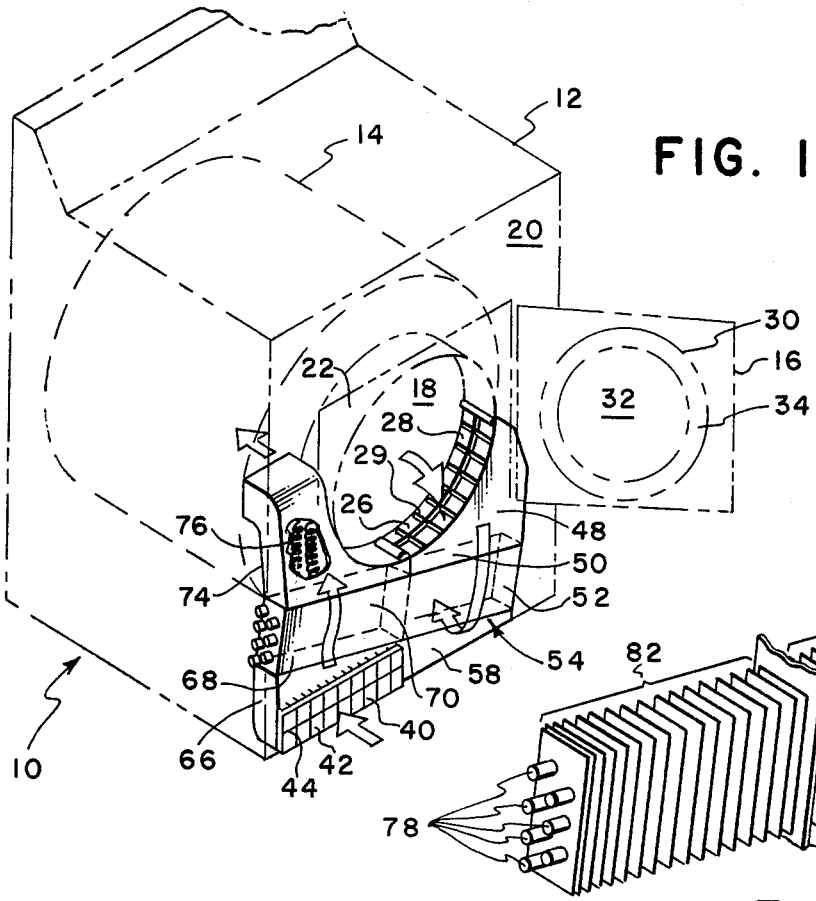
FIG. 1 is a frontal perspective view of a dryer according to the invention, with a dryer housing and drum shown in outline.
Figure 2:
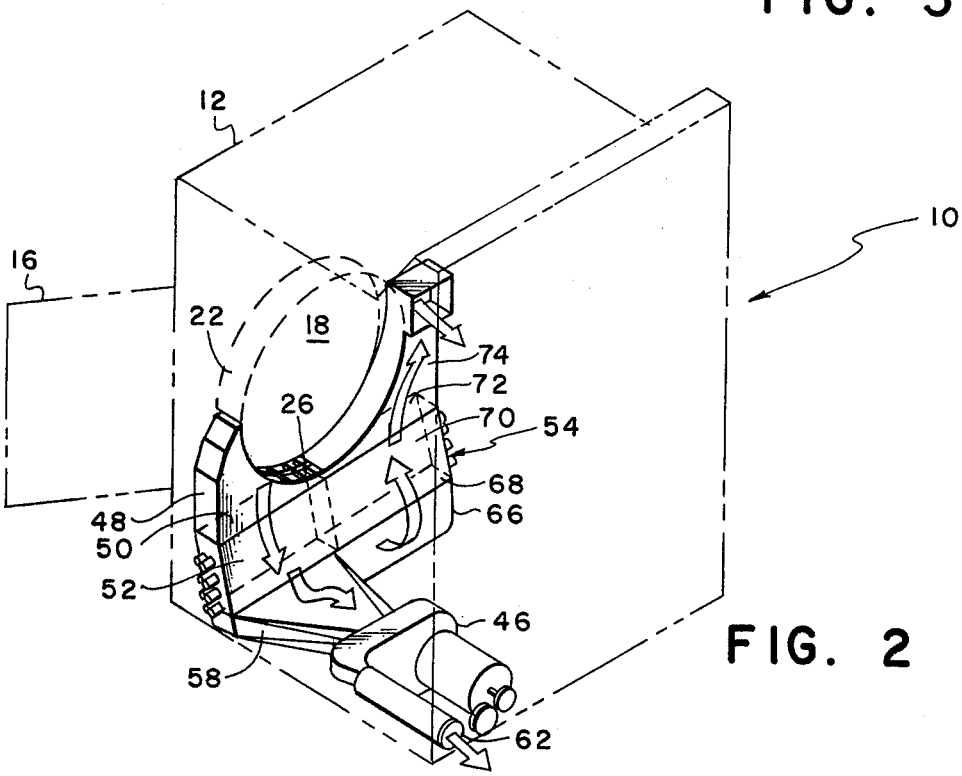
FIG. 2 is a rear perspective view of the dryer shown in FIG. 1, eliminating the outline of the dryer drum, and including certain additional features.

In FIGS. 1 and 2, there is illustrated a dryer according to the invention, indicated generally by reference numeral 10. The dryer 10 has a housing 12, illustrated in outline, which is of a standard overall size and shape. Laundry to be dried is held in drum 14, shown in FIG. 1, in outline. Access to the drum 14 is provided by a door 16 which covers an opening 18 in the front panel of housing 12. Since the drum 14 is recessed somewhat behind the front panel 20 of housing 12, there is a wall 22 several inches wide around opening 18. Wall 22 defines a sort of short passage from the front panel 20 into drum 14. Opening into the passage is an exhaust opening 26 which receives the air exhausted from drum 14. Covering the opening 26 is a lint filter 28, which can be formed of relatively fine mesh screen. The filter 28 and a grill 29 covering it are each designed to snap out of position from wall 22. On the rear of door 16 there is a raised portion 30 which fills passage 24 when door 16 is closed. Portion 30 has a flat surface 32 parallel to the door and a wall 34 which is next to wall 22 when door 16 is closed. There is a conventional provision of holes (not shown) in surface 32 and wall 34, which allow air to flow from drum 14 to exhaust opening 26 when door 16 is closed.

In front panel 20 is an intake opening 40, which receives fresh air entering the dryer 10. Intake opening 40 is covered by an air filter 42 of fine mesh screen. Filter 42 has a protective grill 44 covering it. Grill 44 and filter 42 can both be snapped out of their positions covering intake opening 40.

The opening 26 for the exhaust air from drum 14 is the inlet of an exhaust duct 48. The outlet of duct 48 is the inlet 50 of high temperature passage 52 of a thermal recovery unit 54. The outlet of the high temperature passage 52 connects to exhaust duct 58 which leads to the intake of a blower 46 (seen in FIG. 2 only). Exhaust 62 of dryer 10 is taken from the exhaust of blower 46.

A short intake duct 66 connects the intake opening 40 with the inlet 68 of a low temperature passage 70 of thermal recovery unit 54. The outlet 72 of low temperature passage 70 leads into a larger intake duct 74 which leads to drum 14. Intake duct 74 contains the elements of a conventional electrical heater 76.

Figure 3:
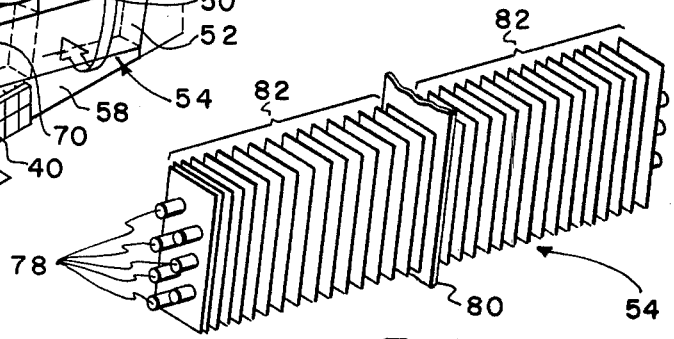
FIG. 3 is a perspective view showing interior details of the thermal recovery unit employed in the dryer of FIG. 1.

FIG. 3 shows internal features of the thermal recovery unit 54. There is a number of heat pipes 78 which project through the high temperature passage 52, low temperature passage 70 and a partition 80, that seals passage 52 from passage 70. There is a large number of fins 82, each of which contacts all of the heat pipes 78, thereby increasing the effective area of heat transfer between the air and heat pipes 78. The fins 82 are closely spaced, for example, at fourteen fins per inch along heat pipes 78. To enhance the performance of heat pipes 78 and thereby of thermal recovery unit 54, the pipes are preferably tilted downward toward the high temperature passage 52, for example, with a 10% slope.

The heat pipes 78 in thermal recovery unit 54 are preferably of the kind described in U.S. Pat. No. 3,865,184, "Heat Pipe and Method and Apparatus for Fabricating Same." Such pipes have an elongate, tubular envelope with a large number of capillary grooves inside, each groove extending around the interior periphery of the envelope. Inside the envelope is a working fluid having a liquid phase and vapor phase, with the liquid phase standing in at least a portion of the envelope.

Figure 4:
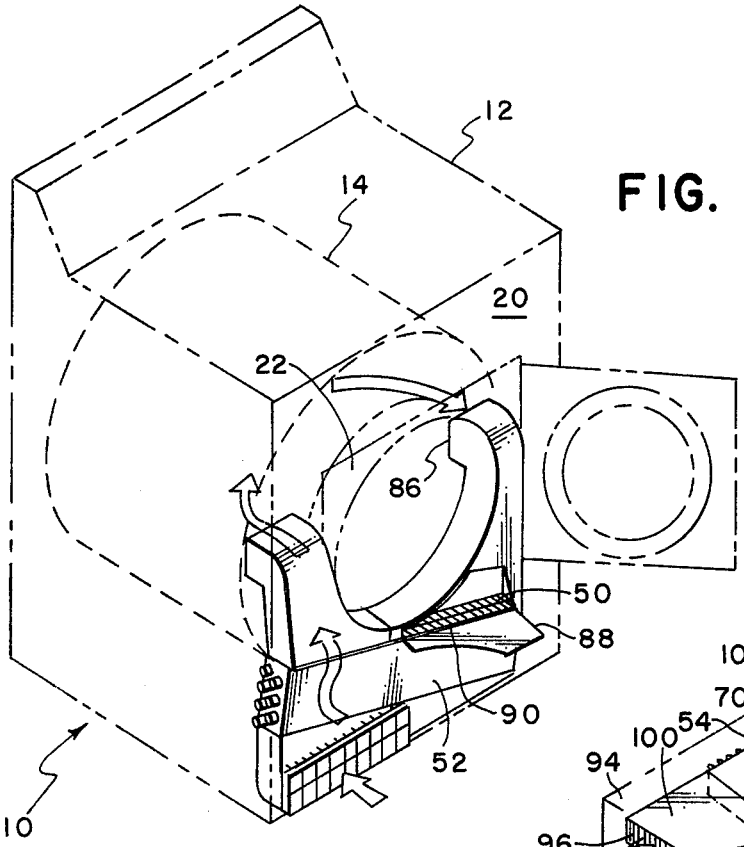
FIG. 4 is a perspective view of a second embodiment of a dryer according to the invention.

FIG. 4 shows an alternate embodiment of dryer 10. In this embodiment exhaust duct 86 opens into the front face of drum 14, rather than into wall 22. An access door 88 in the front panel 20 of housing 12 opens into an exhaust duct 86 at the inlet 50 of high temperature passage 52. A lint filter 90, overlying inlet 50, is removable through door 88.

Figure 5:
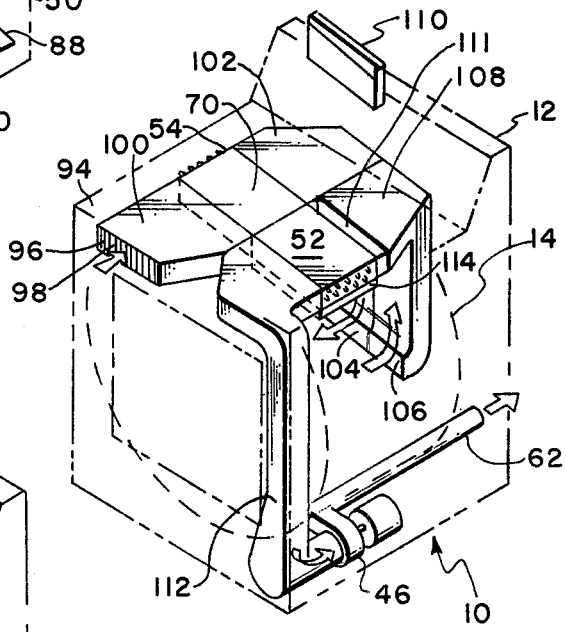
FIG. 5 is a perspective view of a third embodiment of the invention, with a removable filter shown in a disengaged condition.

In the embodiment of dryer 10 shown in FIG. 5, the thermal recovery unit 54 lies between drum 14 and the top panel 94 of housing 12. Fresh air enters an intake opening 96 in front panel 20, passing through a removable grill 98 and removable air filter, not shown, immediately behind the grill. The air is then led by an intake duct 100 to the low temperature passage 70 of thermal recovery unit 54. A larger intake duct 102, containing a heater, not shown, directs the air to an inlet 96 at the rear of drum 14.

Exhaust air from drum 14 enters an exhaust opening 106 at the rear of the drum. An exhaust duct 108 directs the exhaust stream to pass through a lint filter 110. Filter 110 can be removed, through top panel 94 of housing 12, from its operating position 111. The filter is shown removed in FIG. 5. After passing through filter 110, the exhaust stream enters the high temperature passage 52 of the thermal recovery unit 54, then is carried by an exhaust duct 112 to blower 46, from which exhaust 62 carries the air out of the dryer 10.

In the dryer of FIG. 5, the high temperature passage 52 of thermal recovery unit 54 is open on the lower side to a moisture collecting tray 114. As in the previously described embodiments, the thermal recovery unit 54 can be made more efficient, if it is arranged so that the end of each heat pipe in the high temperature passage 52 is somewhat lower than the end in the low temperature passage 70.

Figure 6:
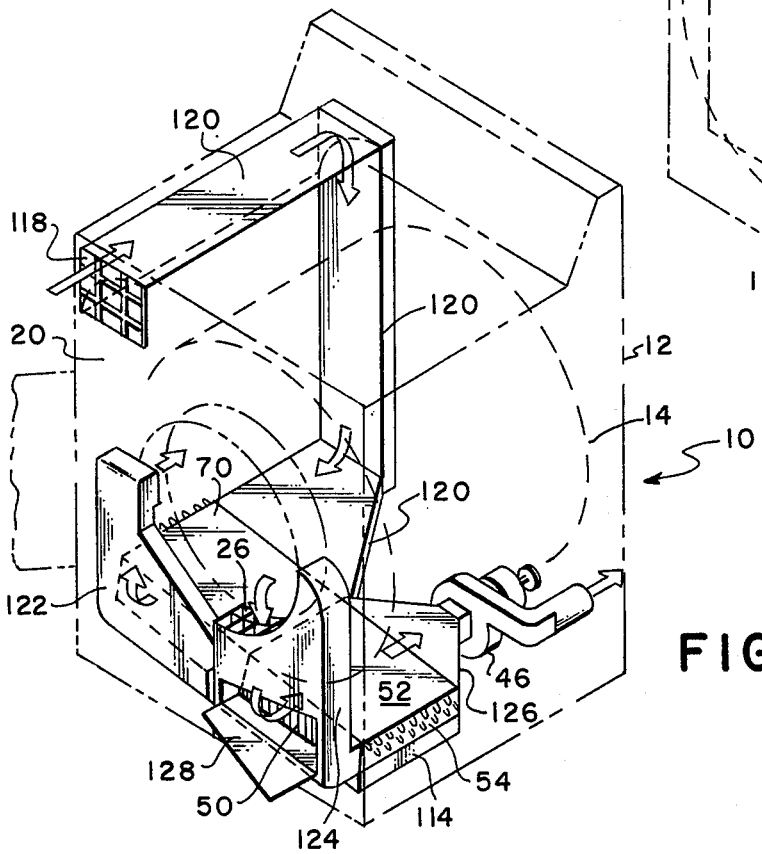
FIG. 6 is a perspective view of a fourth embodiment of the invention.

In the embodiment of FIG. 6, the thermal recovery unit 54 is beneath drum 14. As illustrated, the unit is slightly tilted toward the high temperature end. Fresh air for the dryer enters an intake opening 118 in the front panel 20 of housing 12. The entering air passes through a removable grill and air filter covering opening 118 into an intake duct 120. Duct 120 routes the air along the top left hand corner of the dryer 10, down the back, then along the bottom of the dryer to the thermal recovery unit 54. After the entering air passes through the low temperature passage 70, another intake duct 122, containing a heater, directs the flow into the front of drum 14. As in the embodiment of FIGS. 1 and 2, exhaust from drum 14 is through an exhaust opening 26, which holds a filter guarded by a removable grill. An exhaust duct 124 carries the exhaust stream to the high temperature passage 52 of the thermal recovery unit 54. Another exhaust duct 126 connects high temperature passage 52 with the blower 46. An access door 128 in front panel 20 opens into exhaust duct 124, exposing the inlet 50 of the high temperature passage 52. A moisture tray 114 lies along the whole bottom of high temperature passage 52 and is open thereto.

In the operation of the embodiment illustrated in FIGS. 1 and 2, blower 46 creates a flow of fresh air entering intake opening 40 and flowing through intake duct 66 and low temperature passage 70 of thermal recovery unit 54. The air then flows through intake duct 74, where it is heated by heater 76. From duct 74 the air enters drum 14, where it loses heat to and absorbs moisture from laundry in the drum.

Blower 46 causes the air to exhaust from drum 14 through exhaust opening 26. The air thus exhausted flows through exhaust duct 48 and high temperature passage 52 of the thermal recovery unit 54. The exhausted air then continues into duct 58, through blower 46 and out the exhaust 62.

In the high temperature passage 52 of thermal recovery unit 54, heat from the exhaust air flowing through is transferred by means of fins 82 to heat pipes 78. Heat pipes function as a heat exchange element by employing heat absorbed at the high temperature end to evaporate a working fluid contained within the heat pipe. The evaporated working fluid moves into the low temperature end of the heat pipe and condenses, giving off the heat of condensation at that end. Thus, heat absorbed by heat pipes 78 in the high temperature passage 52 is transferred by the pipes into low temperature passage 70 and transmitted, by way of fins 82, to the air flowing through passage 70. The condensed working fluid then returns to the high temperature end to again absorb heat.

The use of heat pipes in thermal recovery unit 54 is important to the success of the present invention. Primarily, the heat pipes provide a miniturized heat transfer unit with the heat transfer capacity required for significant thermal recovery. In this regard, it is particularly important to use the type of heat pipe with interior capillary grooves, as described above. Such a device provides a significantly better efficiency than an ordinary heat pipe. A second advantage of a heat pipe unit is that it has a lower resistance to air flow than a comparable indirect heat exchanger. This is important, because a home dryer cannot use an arbitrarily large blower to drive its air stream.

By means of thermal recovery unit 54, heat from the hot moist air, exhausted by drum 14 and flowing through high temperature passage 52, is transferred to the fresh air flowing through low temperature passage 70. As a consequence of heating the fresh air as it passes through passage 70, heater 76 does not have to use as much energy to heat the air flowing through intake duct 74 in order to raise the air to a selected temperature before the air enters drum 14.

In dryer 10, the flow of exhaust air through high temperature passage 52 is opposite to the direction of the flow of fresh air through the low temperature passage 70. Such a counterflow condition produces a heat exchange between the two ducts which is higher than that which would be obtained were both air streams flowing in the same direction. Another factor which produces improved performance of the thermal recovery unit 54 is the downward tilt of the high temperature end of the unit. The tilt aids the return of the condensed working fluid from the low temperature end of the heat pipes 78 to the high temperature end.

In the dryer 10, passages 52 and 70 are not two separate pieces of duct work; they are just separated by a metal partition 80. Because of the good thermal conductivity of the metal, some heat transfer will be gained by direct conduction through the partition 80.

The exhaust air traveling through the high temperature passage 52 contains moisture absorbed from laundry in drum 14. When heat is transferred from the exhaust air by thermal recovery unit 54, the air is cooled and the amount of moisture that it can hold is reduced. Accordingly, there can be some condensation of moisture in high temperature passage 52. Since too much moisture in thermal recovery unit 54 can adversely affect heat transfer, it is desirable that the water be removed effectively. The moisture will flow downward in duct 52 due to gravity, and this process is aided by having the flow of exhaust air through duct 52 be downward. The water tends to collect in exhaust duct 58, from which it evaporates when the dryer is not in use.

The air filters 42 and 28 deal with a basic problem in the use of heat exchangers. If there are substances in the air stream which can collect on the elements of the heat exchanger, the gradual accumulation of these substances can eventually impede flow through the exchanger and produce an insulating barrier between the heat exchange elements and the air stream. The major portion of such substances are dealt with in the dryer 10 by protecting the inlets to the ducts of thermal recovery unit 54 with filter screens of the type conventionally used in the exhaust flow of home dryers. The filter 42 will protect the elements of the low temperature passage 70 from much of the particulate matter in the room where the dryer 10 operates, such as dust and carpet lint. Filter 28 will collect most of the laundry lint that leaves the drum 14. When the filters are seen to be covered with collected material, the material is simply peeled off the filter. Filter 42 is covered by a protective grill 44 to keep the filter from being accidentally kicked in. Grill 44 can be snapped off in order to facilitate cleaning filter 42.

Some lint and dust can be expected to penetrate filters 28 and 42. For this reason, the fins 82 of the thermal recovery unit 54 are closely spaced so that material will accumulate on the edges of the fins 82 at the inlets of the thermal recovery unit ducts, rather than penetrate into the ducts and accumulate on the heat pipes 78. When there is an appreciable accumulation of material on the fins 82 in the inlets of the thermal recovery unit ducts, it can be vacuumed off. Both filters 28 and 42 snap out of position. The inlet 50 of duct 52 can be accessed through exhaust opening 26 and exhaust duct 48 for cleaning of the fins. Inlet 68 of low temperature duct 70 is reached through intake opening 40 and intake duct 66.

The use of the embodiment in FIG. 4 differs from that of FIGS. 1 and 2 mainly in the removal of lint on the exhaust side of the system. Door 88 can be opened to permit the cleaning of filter 90. Then the filter 90 may be removed for vacuum cleaning of lint from fins 82 in the inlet 50 of high temperature passage 52.

In the embodiment of FIG. 5, grill 98 is snapped out in order to clean the filter screen. The filter screen can then be removed in order to vacuum the inlet of the low temperature passage 70 via the intake duct 100. On the exhaust side, the removal of filter 110 not only allows it to be cleaned, but provides an opening through which to clean fins in the inlet of high temperature passage 52.

Again in the embodiment of FIG. 6, a grill may be removed from intake opening 118 in order to expose an air filter for cleaning. The same is true of the grill covering exhaust opening 26. Rather than attempt to vacuum inlet 50 of the high temperature passage 52 by reaching through exhaust duct 124, a door 128 has been provided through which this may be performed.

The moisture tray 114, in the embodiments of FIGS. 5 and 6, collects the condensate from the thermal recovery unit 54, described above in connection with FIG. 1. The location of pan 114 immediately below the high temperature passage 52 prevents any significant pooling of water in the thermal recovery unit itself. Some of the condensed water will blow out the exhaust 62 as droplets; that which collects in pan 114 can evaporate, while the dryer is not in use.

There are several features of dryer 10 which are thought to contribute to its practicality for home operation. First, it is designed to fit into the standard space often provided for home dryers in laundry rooms. It is envisioned that one side of dryer 10 may be next to a wall, while the other side is next to a washer. The space above dryer 10 is also expected to be restricted, though somewhat less than the sides. Thus the configurations of dryer 10 shown in FIGS. 1 through 6 are advantageous in that they have no parts projecting into the restricted areas, and all of the cleaning which must be performed in conjunction with thermal recovery unit 54 is accessible from the front and top of the machine.

The embodiments of FIGS. 1 and 6 have an advantage in the extent to which material accumulated on the air filters is apparent to the user of dryer 10. The location of the filters makes them readily observed and minimizes the chance that the user will allow the air streams to become blocked by filter stoppage.

Although preferred embodiments of the invention have been described in detail, it is to be understood that various changes, substitutions and alterations can be made therein without departing from the spirit of the invention as defined by the appended claims.

What is claimed is:

1. A home laundry dryer comprising a housing of substantially standard size and, in said housing:

a drum to contain the laundery;

blower means for generating a flow of air entering the drum and a flow of air exhausted therefrom;

a thermal recovery unit, including a low temperature passage and a high temperature passage, a thermally conductive partition disposed intermediate the low temperature passage and high temperature passage providing fluid isolation of the low temperature passage relative to the high temperature passage while permitting heat transfer from heated air in the high temperature passage to relatively cooler air in the low temperature passage by conduction and radiation through the thermally conductive partition;

a plurality of heat pipes in said passages, each heat pipe extending through said thermally conductive partition and substantially across each of the passages, each pipe having a plurality of fins in contact therewith;

an intake duct connected to direct said entering air to the drum from the outlet of the low temperature duct, whereby the entering air is drawn through the low temperature passage from the inlet thereof;

heater means in the intake duct for heating said entering air; and an exhaust duct connected to direct said exhausted air to the inlet of the high temperature passage to flow therethrough in a direction opposite to the flow of the entering air in the low temperature passage, whereby heat can be transferred to the entering air in the low temperature passage from exhausted air in the high temperature passage.

2. The dryer of claim 1, further including means in said housing for opening said exhaust duct and exposing said inlet of the high temperature passage.

3. The dryer of claim 2, further having a filter interposed in said entering air flowing to said low temperature passage.

4. The dryer of claim 3, further including a filter interposed in said exhausted air flowing to said high temperature passage.

5. The dryer of claim 4, further including means in said housing for exposing said inlet of the low temperature passage.

6. The dryer of claim 1, further including means below said high temperature passage and open thereto, for collecting moisture from the high temperature passage.

7. The dryer of claim 1, wherein each of said passages of the thermal recovery unit is adjacent the front of said housing.

8. The dryer of claim 7, wherein the passages of the thermal recovery unit are approximately vertical, with the inlet of the low temperature passage being at the bottom end thereof and the inlet of the high temperature passage being at the top end thereof.

9. The dryer of claim 1, wherein each of said fins contacts all of the heat pipes.

10. The dryer of claim 1, wherein the portion of each heat pipe in the high temperature passage is lower than the portion of the pipe in the low temperature passage.

11. The dryer of claim 1, wherein said passages have a common wall.

12. The dryer of claim 1, wherein each of said heat pipes is comprised of an elongate tubular envelope with a plurality of capillary grooves, each extending around substantially the entire interior periphery of the envelope, and a working fluid having a liquid phase and a vapor phase, the liquid phase standing in at least a portion of the envelope.

13. A home laundry dryer comprising a housing of substantially standard size and, in said housing:

a drum to contain the laundry;

means including a wall extending from the front of the housing to the drum, for providing access thereto;

blower means for generating a flow of air entering the drum and a flow of air exhausted therefrom;

a thermal recovery unit, including a high temperature passage and a low temperature passage having a wall in common, each passage being approximately vertical and adjacent the front of said housing, the inlet of the low temperature passage being at the bottom end thereof and the inlet of the high temperature passage being at the top end thereof, a plurality of heat pipes in said passages, each projecting through the wall, and extending across said high temperature passage and said low temperature passage with the portion of each pipe in the high temperature passage being lower than the portion of the pipe in the low temperature passage, and a plurality of fins in each of the passages, each fin contacting all of the heat pipes;

a first intake duct connected to direct said entering air to the drum from the outlet of the low temperature passage;

heater means in the first intake duct for heating said entering air;

a second intake duct having an inlet opening at the front of the housing and connected to direct said entering air to the inlet of the low temperature passage from said opening;

a first filter, covering said opening, said filter being removable and said second intake duct being shaped to permit access to the inlet of the low temperature passage through said second intake duct;

an exhaust duct having an inlet opening into said wall and connected to direct said exhausted air to the inlet of said high temperature passage; and a second, removable filter, covering the inlet of said exhaust duct:

whereby, in the thermal recovery unit, heat can be transferred to said entering air in said low temperature passage from exhausted air in the high temperature passage.

14. A home laundry dryer comprising a housing of substantially standard size and, in said housing:

a drum to contain the laundry;

blower means for generating a flow of air entering the drum and a flow of air exhausted therefrom;

a thermal recovery unit, including a high temperature passage and a low temperature passage having a wall in common, each passage being approximately vertical and adjacent the front of said housing, the inlet of the low temperature passage being at the bottom end thereof and the inlet of the high temperature passage being at the top end thereof, a plurality of heat pipes in said passages, each projecting through the wall, and extending across each of the passages, with the portion of each pipe in the high temperature passage being lower than the portion of the pipe in the low temperature passage, and a plurality of fins in each of the passages, each fin contacting all of the heat pipes;

an intake duct connected to direct said entering air to the drum from the outlet of the low temperature passage;

heater means in the intake duct for heating said entering air;

an exhaust duct connected to direct said exhausted air to the inlet of said high temperature passage; and a door at the front of said housing, opening the exhaust duct near the high temperature duct inlet to permit access thereto;

whereby, in the thermal recovery unit, heat can be transferred to said entering air in said low temperature passage from exhausted air in the high temperature passage.

15. The dryer of claim 1, wherein the thermal recovery unit is beneath the drum and the flow in each of the passages of said unit is approximately horizontal.

16. The dryer of claim 15, wherein the inlet of the low temperature passage is toward the rear of the dryer and the inlet of the high temperature passage is toward the front of the dryer, and further including a door at the front of said housing, opening said exhaust duct near the high temperature passage inlet to permit access thereto.

17. A home laundry dryer comprising a housing of substantially standard size and, in said housing:

a drum to contain the laundry;

blower means for generating a flow of air entering the drum, and a corresponding flow of said air exhausted from the drum:

a thermal recovery unit beneath the drum, including a high temperature passage and a low temperature passage having a wall in common, the flow in each passage being approximately horizontal, and the inlet of the low temperature passage being toward the rear of the dryer, with the inlet of the high temperature passage toward the front of the dryer, a plurality of heat pipes in said passages, each projecting through the wall and extending across each of the passages, and a plurality of fins in each of the passages, each fin contacting all of the heat pipes;

a first intake duct connected to direct said entering air to the drum from the outlet of the low temperature passage, heater means in said intake duct for heating said entering air;

a second intake duct having an inlet opening in said housing and connected to direct said entering air to the inlet of the low temperature passage from said opening;

an air filter in the second intake duct;

an exhaust duct carrying said exhausted air from the drum to the inlet of the high temperature passage; and means for opening the front of said housing and said exhaust duct to expose said inlet of the high temperature passage;

whereby some of the heat energy imparted to the entering air by said heater means can be recovered in the high temperature passage from said exhausted air and transferred in the low temperature passage to the entering air.

18. The dryer of claim 1, wherein the thermal recovery unit is between the drum and the top of said housing, with the flow in each passage of said unit being approximately horizontal.

19. A home laundry dryer comprising a housing of substantially standard size and, in said housing:

a drum to contain the laundry;

blower means for generating a flow of air entering the drum, and a corresponding flow of said air exhausted from the drum:

a thermal recovery unit between the drum and the top of said housing, including a high temperature passage and a low temperature passage having a wall in common, the flow in each passage being approximately horizontal, and the inlet of one of said passages being toward the front of the dryer, with the inlet of the other of said passages being toward the rear of the dryer, a plurality of heat pipes in said passages, each projecting through the wall and extending across each of the passages, and a plurality of fins in each of the passages, each fin contacting all of the heat pipes;

an intake duct connected to direct said entering air to the drum from the outlet of the low temperature passage;

heater means in the intake duct for heating said entering air;

an exhaust duct connected to direct said exhausted air from the drum to the inlet of the high temperature passage;

a filter at the inlet of said high temperature passage; and, means for removing said filter for exposing said inlet of the high temperature duct;

whereby some of the heat energy imparted to the entering air by said heater means can be recovered in the high temperature passage from said exhausted air and transferred in the low temperature passage to the entering air.

20. In a home laundry dryer, the combination of:

a drum for containing laundry to be dried;

an inlet duct for conveying air from outside of the dryer into the drum;

an exhaust duct for conveying air discharged from the drum; and, a plurality of heat pipes each including evaporator and condenser end portions which in combination define a closed envelope containing a working fluid characterized by a liquid phase and a vapor phase at the operating temperatures of the condenser and evaporator end portions, respectively, each heat pipe being capable of transferring heat in response to vaporization of the working fluid in the evaporator end portion of the heat pipe and in response to condensation of the vaporized working fluid in the condenser end portion of the heat pipe, respectively, the heat pipes extending between the inlet and exhaust ducts with the condenser end portion of each heat pipe being disposed in heat exchange relationship with air conveyed through the inlet duct into the drum, and the evaporator end portion of each heat pipe being disposed in heat exchange relationship with air discharged from the drum and conveyed through the exhaust duct.

* * * * *